US010343817B2

(12) United States Patent
Shafer

(10) Patent No.: US 10,343,817 B2
(45) Date of Patent: Jul. 9, 2019

(54) FOOD CONTAINING SYSTEM AND DEVICES

(71) Applicant: Steven Shafer, Gainesville, FL (US)

(72) Inventor: Steven Shafer, Gainesville, FL (US)

( * ) Notice: Subject to any disclaimer, the term of this patent is extended or adjusted under 35 U.S.C. 154(b) by 134 days.

(21) Appl. No.: 15/449,476

(22) Filed: Mar. 3, 2017

(65) Prior Publication Data

US 2018/0251264 A1 Sep. 6, 2018

(51) Int. Cl.
*B65D 5/56* (2006.01)
*B65D 25/14* (2006.01)
*B65D 85/78* (2006.01)

(52) U.S. Cl.
CPC ..... *B65D 25/14* (2013.01); *B65D 85/78* (2013.01)

(58) Field of Classification Search
CPC ..... B65D 25/14; B65D 85/78; B65D 5/566; B65D 25/16
USPC ..... 229/117.3; 220/8, 666, 23.83, 23.87, 220/23.88, 23.9, 501, 506, 528, 529, 220/908.1, 908.3, 495.01, 495.03, 495.05, 220/4.26
See application file for complete search history.

(56) References Cited

U.S. PATENT DOCUMENTS 1,680,882 A 8/1928 Carl
1,861,112 A 5/1932 Christian
2,348,622 A * 5/1944 Heilman ..... B65D 5/566 206/524.3
2,444,861 A 7/1948 Symmes
2,961,849 A 11/1960 Hitchcock
3,856,178 A * 12/1974 Norgaard ..... B65D 21/0213 206/499
4,872,589 A 10/1989 Englehart et al.
5,514,299 A 5/1996 Kalwara
5,944,251 A 8/1999 LaFleur
6,331,334 B1 12/2001 Trepte et al.

* cited by examiner

*Primary Examiner* — Fenn C Mathew
*Assistant Examiner* — Elizabeth J Volz
(74) *Attorney, Agent, or Firm* — Patentfile, LLC; Bradley C. Fach; Steven R. Kick

(57) ABSTRACT

A food containing system may include one or more food container liners, such as a first food container liner and/or a second food container liner, and an optional food container. A food container liner may include a side wall bounding a liner cavity. The side wall may have an open top end, an open bottom end, an interior surface, and an exterior surface. A food container may include a container wall bounding a food receiving cavity. The container wall may have an open container top end, a container bottom end, a container interior surface, a container exterior surface, and a base coupled to the container bottom end. A first food container liner may be removably positioned or nested within the food receiving cavity of the food container. A second food container liner may be removably positioned or nested within the liner cavity of the first food container liner.

12 Claims, 5 Drawing Sheets

FOOD CONTAINING SYSTEM AND DEVICES

FIELD OF THE INVENTION

This patent specification relates to the field of systems and devices for containing and dispensing food items. More specifically, this patent specification relates to systems and devices for containing and dispensing food items while improving the presentation of the food items.

BACKGROUND

In the food business, presentation of food items is considered essential. Presentation or the visual appearance of food items often forms a customer's first impression of the food items. An attractive and appealing presentation stimulates the desire to taste the food, while an improper or unattractive display may remove or diminish the desire to taste the food.

In food businesses that dispense from food from bulk containers, such as ice cream, the presentation of the food in the bulk containers can make or break a business. For example, ice cream and other frozen food items, such as frozen yogurt, gelato, sherbet, sorbet, and the like, are often stored in large bucket or tub-like containers which are positioned in a cooler having a glass wall through which customers may observe the food item. As the ice cream or the like is removed from the containers, some residual ice cream will be left stuck to the sides of the containers. In order to improve the presentation of the containers, and to conserve product, workers will often scrape the residual food product down into contact with the remaining product in the container. Not only can this result in possible food contamination, but customers also find this scraping visually unappealing.

Therefore a need exists for novel systems and devices for containing and dispensing food items while improving the presentation of the food items. There is also a need for novel systems and devices which eliminate the need and time wasted in having to scrape or wipe down the inner sides of containers. Finally, a need exists for novel systems and devices for containing and dispensing food items which allow the food items to be continuously dispensed from a visually appealing container.

BRIEF SUMMARY OF THE INVENTION

A food containing system is provided. The system may include one or more food container liners which may shield portions of the interior surface of a food container or another food container liner from contact with a food item inserted therein. Preferably, a food container liner may be inserted into a food container, so that the food container liner covers portions of the interior surface of the food container, and a food item may be inserted into the food container and the food container liner. Once the food container liner is removed from the food container, the interior surface covered by the food container liner will be clean having little to no residual food item on the interior surface thereby resulting in a visually appealing food container.

In some embodiments, a food containing system may include at least one food container liner. In further embodiments, a food containing system may include two or more food container liners and/or a food container. In still further embodiments, a food containing system may include two or more food container liners and a food container in which a first food container liner is capable of being removable from the food receiving cavity of the food container and in which a second food container liner is capable of being removable from the first liner cavity of the first food container liner.

In some embodiments, a first food container liner may include a first side wall bounding a first liner cavity. The first side wall may have a first open top end, a first open bottom end, a first interior surface, and a first exterior surface. A first lip may extend around the first bottom end, and the first lip may be configured to contact a food container.

In further embodiments, a second food container liner may include a second side wall bounding a second liner cavity. The second side wall may have a second open top end, a second open bottom end, a second interior surface, and a second exterior surface. A second lip may extend around the second bottom end, and the second lip may be configured to contact a first interior surface of a first food container liner.

In further embodiments, a food container may include a container wall bounding a food receiving cavity. The container wall may have an open container top end, a container bottom end, a container interior surface, and a container exterior surface. A base may be coupled to the container bottom end to bound the container bottom end thereby allowing the food container to be able to hold or contain a volume of a food item, such as ice cream or the like, within the food receiving cavity.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
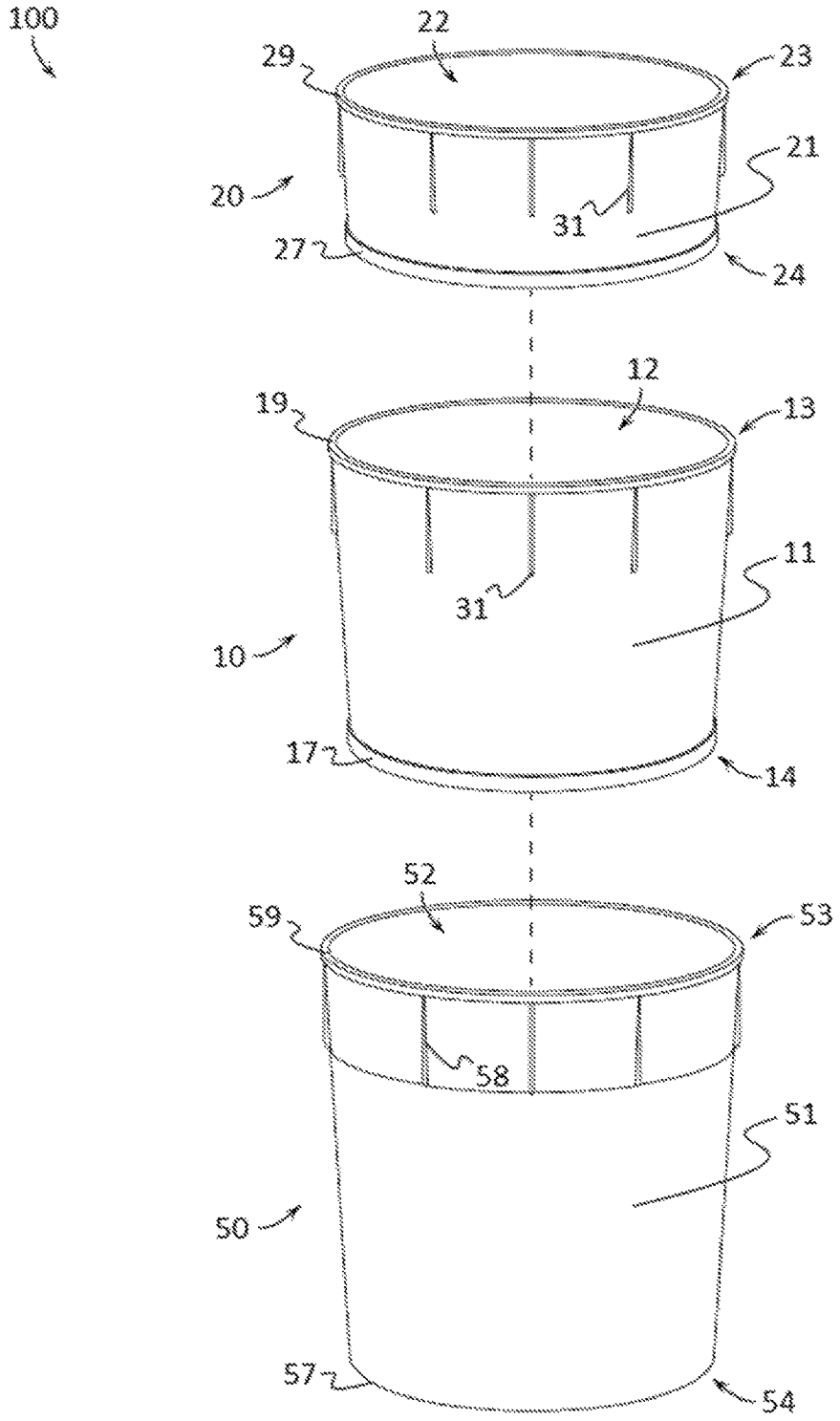
FIG. 1 depicts a perspective view of an example of a first food container liner, a second food container liner, and a food container of a food containing system according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New systems and devices for containing and dispensing food items are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIG. 1 illustrates an example of a first food container liner 10, a second food container liner 20, and a food container 50 of a food containing system 100 according to various embodiments. The food containing system 100 ("the system 100") may comprise one or more food container liners, such as a first food container liner 10 and/or a second food container liner 20, and optionally a food container 50.

Figure 2:
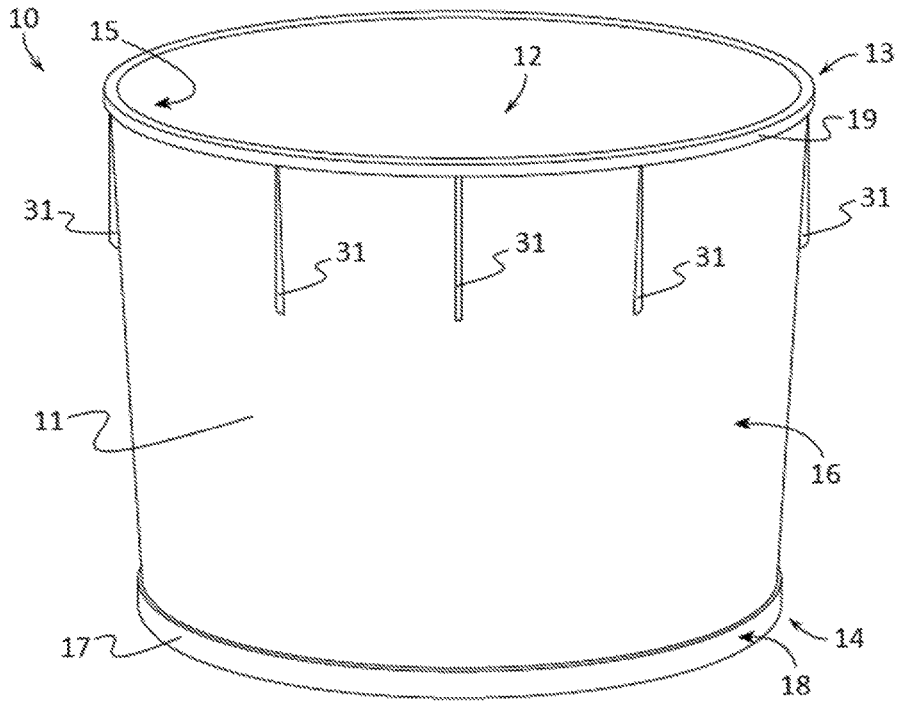
FIG. 2 illustrates a perspective view of an example of a food container liner according to various embodiments described herein.
Figure 3:
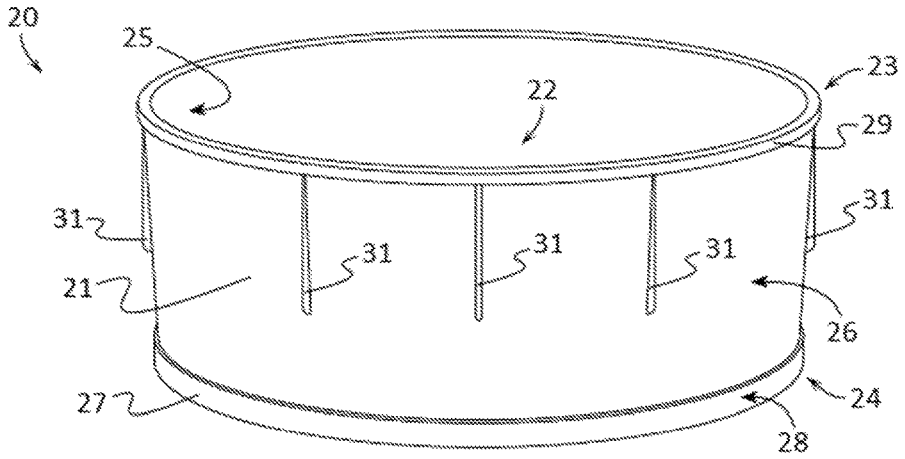
FIG. 3 shows a perspective view of another example of a food container liner according to various embodiments described herein.
Figure 5:
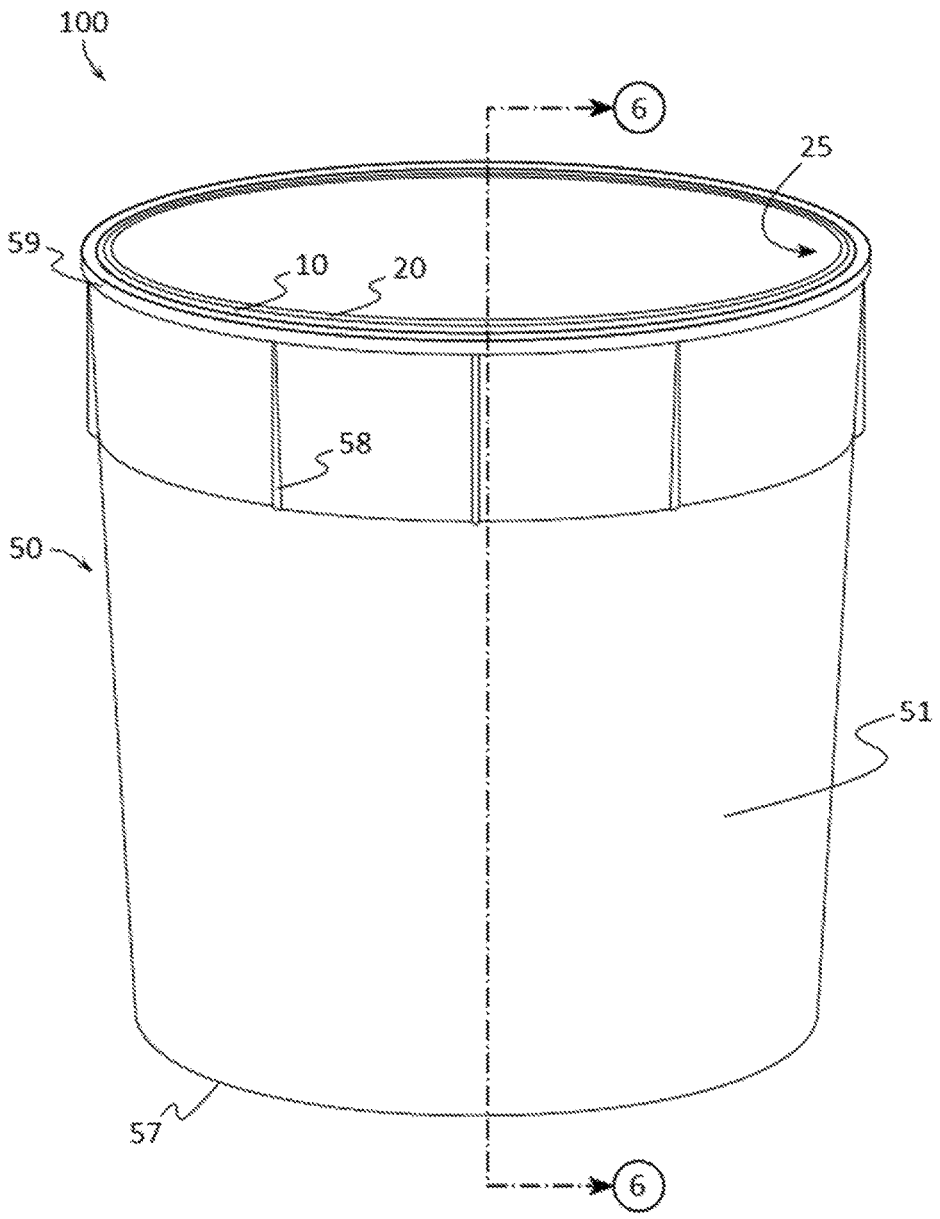
FIG. 5 illustrates a perspective view of an example of a food containing system according to various embodiments described herein.
Figure 6:
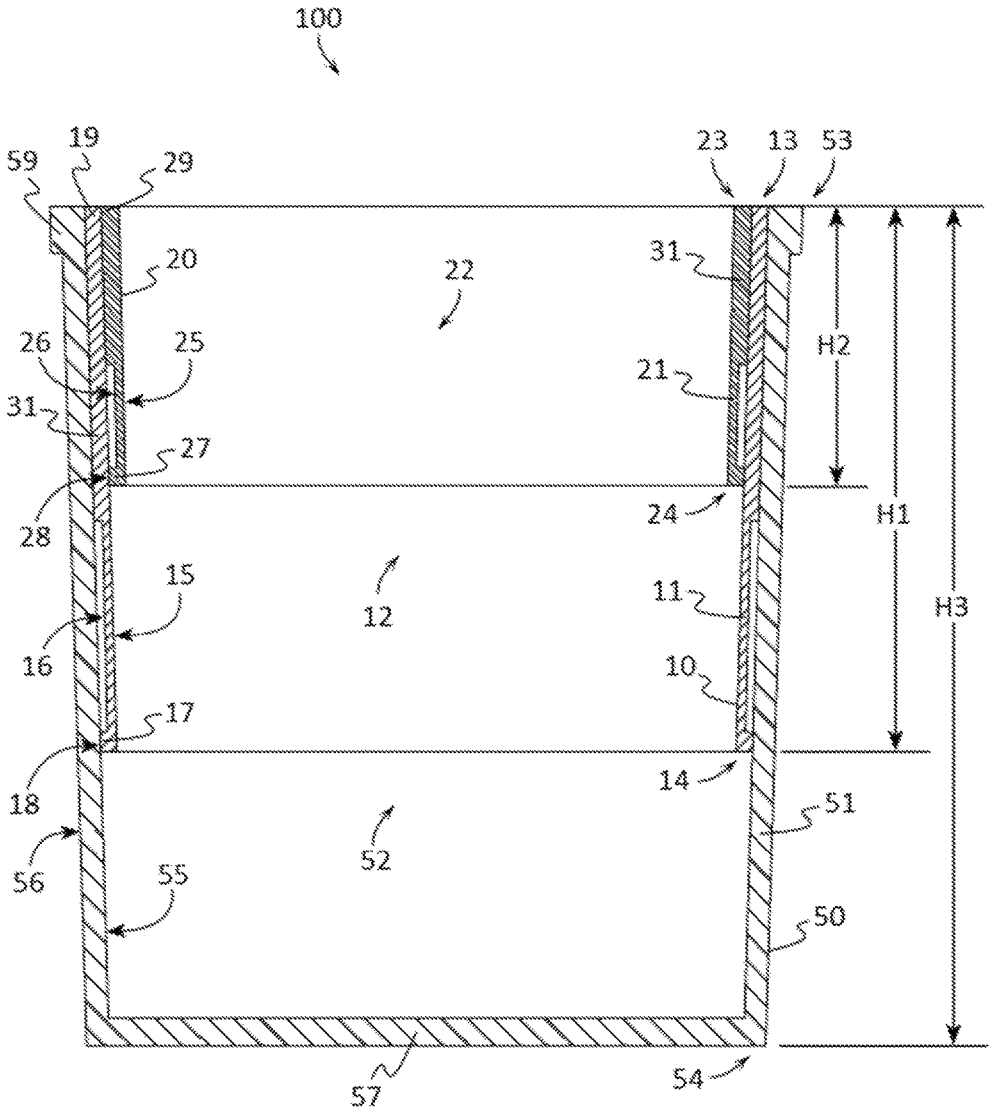
FIG. 6 shows a sectional, through line 6-6 shown in FIG. 5, elevation view of an example of a food containing system according to various embodiments described herein.

In this example, the system 100 comprises a first food container liner 10, a second food container liner 20, and a food container 50. A first food container liner ("the first liner") 10 may comprise a first side wall 11 bounding a first liner cavity 12. The first side wall 11 may have a first open top end 13, a first open bottom end 14, a first interior surface 15 (FIGS. 2 and 6), and a first exterior surface 16 (FIGS. 2 and 6). A first lower lip 17 may extend around the first bottom end 14 and be configured to contact interior portions of a food container 50. A second food container liner ("the second liner") 20 may comprise a second side wall 21 bounding a second liner cavity 22. The second side wall 21 may have a second open top end 23, a second open bottom end 24, a second interior surface 25 (FIGS. 3, 5, and 6), and a second exterior surface 26 (FIGS. 3, 5, and 6). A second lower lip 27 may extend around the second bottom end 24 and be configured to contact the first interior surface 15 of the first food container liner 10. A food container 50 may comprise any suitable container for holding ice cream, frozen yogurt, gelato, sherbet, sorbet, or any other like food items and may comprise a container wall 51 bounding a food receiving cavity 52. The container wall 51 may have an open container top end 53, a container bottom end 54, a container interior surface 55 (FIGS. 4 and 6), a container exterior surface 56 (FIGS. 4 and 6), and a base 57 coupled to the container bottom end 54.

FIG. 2 illustrates a perspective view of an example of a first liner 10 according to various embodiments described herein. In some embodiments, the system 100 may comprise a first liner 10 which may be removably positioned or nested within a food container 50. In some embodiments, the first liner 10 may comprise a comprise a first side wall 11 having a slightly tapering conical shape so that the first top end 13 may be generally larger than the first bottom end 14. In alternative embodiments, a the first liner 10 may comprise a comprise a first side wall 11 having a cylindrical shape so that the first top end 13 may be approximately the same size as the first bottom end 14.

The first side wall 11 may comprise a first interior surface 15 which may form and bound the first liner cavity 12. All or portions of the first interior surface 15 may contact food items placed in the first liner cavity 12 of the first liner 10. In preferred embodiments, the first interior surface 15 and/or the first side wall 11 may be made from or comprise a food-grade material such as nylon, polyurethane, vinyl, High-density polyethylene (HDPE), other types of polyethylene, polyvinyl chloride, rubber, silicone, or other similar food-grade material.

The first side wall 11 may comprise a first exterior surface 16 which may be placed proximate to the container interior surface 55 (FIGS. 4 and 6) of a food container 50 that the first liner 10 may be removably positioned within. In some embodiments, the first side wall 11 may be made from or comprise a flexible food-grade material thereby allowing portions of the first exterior surface 16 to rest against or contact the container interior surface 55 of a food container 50 when the first liner is placed within the food receiving cavity 52 (FIGS. 4 and 6) of a food container 50.

In some embodiments, the first liner 10 may comprise a first lower lip 17 which may extend around the first bottom end 14 and which may be configured to contact a food container 50 when the first liner 10 is received in the food receiving cavity 52 of the food container 50. In preferred embodiments, the first lower lip 17 may comprise a first contact surface 18 which may be raised or extended above the first exterior surface 16 so that the first contact surface 18 will contact and seal to the container interior surface 55 of a food container 50 into which the first liner 10 is placed. In some embodiments, a first upper lip 19 and/or a first contact surface 18 may be raised or extended above the first exterior surface 16 by approximately 0.05 to 0.50 inches and more preferably 0.110 to 0.140 inches. In still further embodiments, a first contact surface 18 may comprise a width of approximately 0.10 to 0.50 inches and more preferably 0.20 to 0.40 inches.

In some embodiments, a first contact surface 18 may comprise a conical and planar shape which may be complementary to a planar shaped container interior surface 55 thereby allowing the first contact surface 18 to be configured to contact the container interior surface 55 and prevent food items from seeping up between the first contact surface 18 and contacting the first exterior surface 16 and portions of the container interior surface 55 adjacent to the first exterior surface 16. In other embodiments, a first contact surface 18 may comprise a cylindrical shape which may be complementary to a planar shaped container interior surface 55 thereby allowing the first contact surface 18 to be configured to contact the container interior surface 55 and prevent food items from seeping up between the first contact surface 18 and contacting the first exterior surface 16 and portions of the container interior surface 55 adjacent to the first exterior surface 16. In still other embodiments, a first contact surface 18 may comprise may comprise any other shape or texturing which may enable the first contact surface 18 to rest against and seal to the container interior surface 55 when a food item is inserted into the first liner cavity 12 and food receiving cavity 52 of a food container 50 when the first liner 10 is positioned within the food container 50.

In some embodiments, the first liner 10 may comprise a first upper lip 19 which may extend around the first top end 13 and which may be configured to contact a food container 50 when the first liner 10 is received in the food receiving cavity 52 of the food container 50. In preferred embodiments, the first upper lip 19 may be raised or extended above the first exterior surface 16 so that the first upper lip 19 will contact and seal to or proximate to the container top end 53 formed by the container interior surface 55 of a food container 50 into which the first liner 10 is placed. In some embodiments, a first upper lip 19 may be raised or extended above the first exterior surface 16 by approximately 0.05 to 0.50 inches and more preferably 0.110 to 0.140 inches.

In some embodiments, the first liner 10 may comprise one or more ribs 31 which may be positioned or disposed anywhere on the first exterior surface 16 and which may provide structural support and rigidity to the first side wall 11. In preferred embodiments, one or more ribs 31 may be positioned proximate to the first top end 13. In further embodiments, one or more ribs 31 may be coupled to the first upper lip 19. A rib 31 may be raised or extended above the first exterior surface 16 so that the rib 31 will contact and rest against the container interior surface 55 of a food container 50 into which the first liner 10 is placed. In this manner, the one or more ribs 31 may create one or more air pockets between the first exterior surface 16 and container interior surface 55 to preferably facilitate the removal of the first liner 10 from the food container 50. In some embodiments, a rib 31 may be raised or extended above the first exterior surface 16 by approximately 0.01 to 0.50 inches and more preferably 0.03 to 0.140 inches. In the examples of FIGS. 1 and 2, the ribs 31 may comprise a generally linear shape. In alternative embodiments, a rib 31 may be configured in any shape and size.

FIG. 3 shows a perspective view of another example of a food container liner according to various embodiments described herein. In some embodiments, the system 100 may comprise a second liner 20 which may be removably positioned or nested within the liner cavity of another food container liner such as within the first liner cavity 12 of a first liner 20.

In some embodiments, the second liner 20 may comprise a second side wall 21 having a slightly tapering conical shape so that the second top end 23 may be generally larger than the second bottom end 24. In alternative embodiments, a the second liner 20 may comprise a comprise a second side wall 21 having a cylindrical shape so that the second top end 23 may be approximately the same size as the second bottom end 24.

The second side wall 21 may comprise a second interior surface 25 which may form and bound the second liner cavity 22. All or portions of the second interior surface 25 may contact food items placed in the second liner cavity 22 of the second liner 20. In preferred embodiments, the second interior surface 25 and/or the second side wall 21 may be made from or comprise a food-grade material such as nylon, polyurethane, vinyl, High-density polyethylene (HDPE), other types of polyethylene, polyvinyl chloride, rubber, silicone, or other similar food-grade material.

The second side wall 21 may comprise a second exterior surface 26 which may be placed proximate to the container interior surface 55 (FIGS. 4 and 6) of a food container 50 that the second liner 20 may be removably positioned within. In some embodiments, the second side wall 21 may be made from or comprise a flexible food-grade material thereby allowing portions of the second exterior surface 26 to rest against or contact the container interior surface 55 of a food container 50 when the second liner is placed within the food receiving cavity 52 (FIGS. 4 and 6) of a food container 50.

In some embodiments, the second liner 20 may comprise a second lower lip 27 which may extend around the second bottom end 24 and which may be configured to contact a first interior surface 15 of a first food container liner 10 when the second liner 20 is received in the food receiving cavity 52 of the food container 50. In preferred embodiments, the second lower lip 27 may comprise a second contact surface 28 which may contact the first interior surface 15 of a first food container liner 10. In some embodiments, a second upper lip 29 and/or a second contact surface 28 may be raised or extended above the second exterior surface 26 by approximately 0.05 to 0.50 inches and more preferably 0.110 to 0.140 inches. In still further embodiments, a second contact surface 28 may comprise a width of approximately 0.10 to 0.50 inches and more preferably 0.20 to 0.40 inches.

In some embodiments, a second contact surface 28 may comprise a conical and planar shape thereby allowing the second contact surface 28 to be configured to contact the first interior surface 15 of a first food container liner 10. In other embodiments, a second contact surface 28 may comprise a cylindrical shape thereby allowing the second contact surface 28 to be configured to contact the first interior surface 15 of a first food container liner 10 In still other embodiments, a second contact surface 28 may comprise may comprise any other shape or texturing which may enable the second contact surface 28 to rest against and seal to the first interior surface 15 of a first food container liner 10 when a food item is inserted into the second liner cavity 22 and food receiving cavity 52 of a food container 50 when the second liner 20 is positioned within the food container 50 and further within the first liner 10.

In some embodiments, the second liner 20 may comprise a second upper lip 29 which may extend around the second top end 23 and which may be configured to contact a first interior surface 15 of a first food container liner 10 within a food container 50 when both the first liner 10 and the second liner 20 are received in the food receiving cavity 52 of the food container 50. In some embodiments, the second upper lip 29 may be raised or extended above the second exterior surface 26 so that the second upper lip 29 will contact and seal to or proximate to the first interior surface 15 of a first food container liner 10. In some embodiments, a second upper lip 29 may be raised or extended above the second exterior surface 26 by approximately 0.05 to 0.50 inches and more preferably 0.110 to 0.140 inches.

In some embodiments, the second liner 20 may comprise one or more ribs 31 which may be positioned or disposed anywhere on the second exterior surface 26 and which may provide structural support and rigidity to the second side wall 21. In preferred embodiments, one or more ribs 31 may be positioned proximate to the second top end 23. In further embodiments, one or more ribs 31 may be coupled to the second upper lip 29. A rib 31 may be raised or extended above the second exterior surface 26 so that the rib 31 will contact and rest against the first interior surface 15 of a first food container liner 10 into which the second liner 20 is placed. In this manner, the one or more ribs 31 may create one or more air pockets between the second exterior surface 26 and the first interior surface 15 of the first food container liner 10 to preferably facilitate the removal of the second liner 20 from the first liner 10 and food container 50. In some embodiments, a rib 31 may be raised or extended above the second exterior surface 26 by approximately 0.01 to 0.50 inches and more preferably 0.03 to 0.140 inches. In the examples of FIGS. 1 and 3, the ribs 31 may comprise a generally linear shape. In alternative embodiments, a rib 31 may be configured in any shape and size capable of creating air pockets to facilitate the removal of the second liner 20 from the first liner 10.

Figure 4:
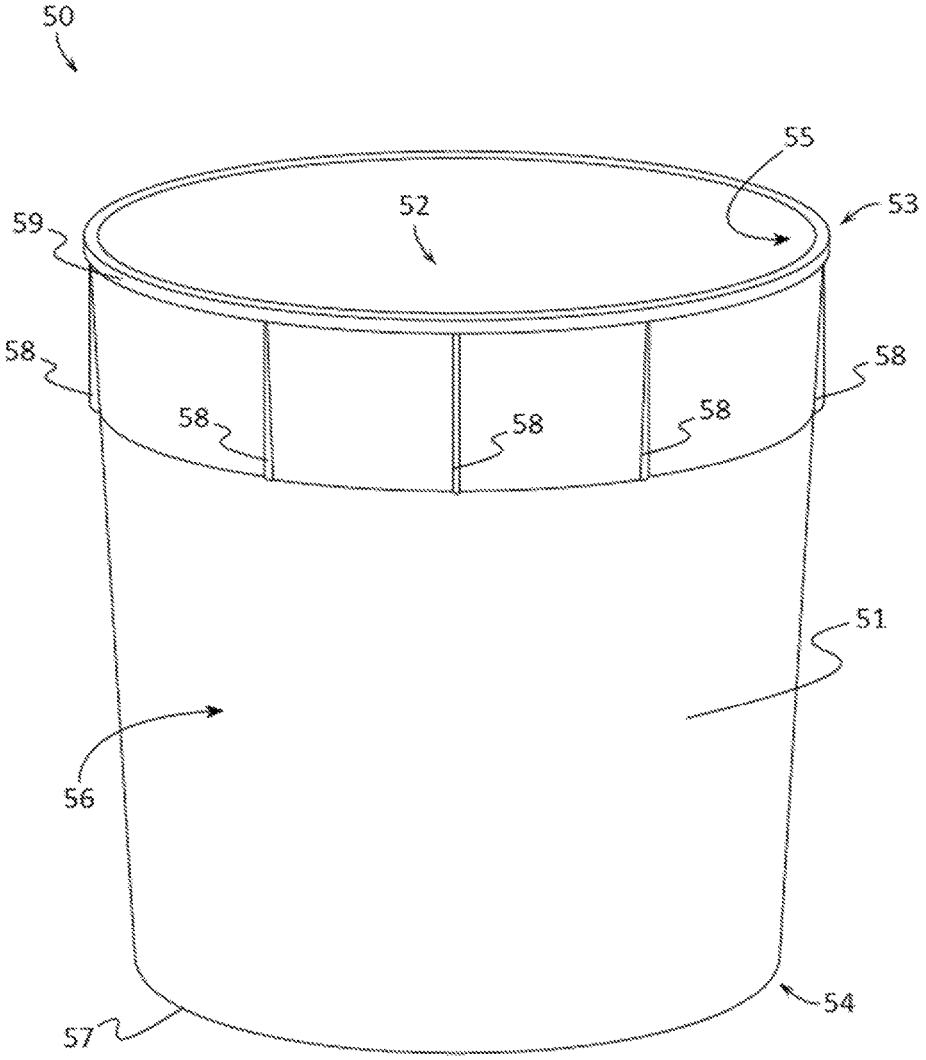
FIG. 4 depicts a perspective view of an example of a food container according to various embodiments described herein.

FIG. 4 depicts a perspective view of an example of a food container 50 according to various embodiments described herein. In some embodiments, the system 100 may comprise a food container 50 which may be capable of holding ice cream, frozen yogurt, gelato, sherbet, sorbet, or any other like food items within its food receiving cavity 52. In preferred embodiments, one or more food container liners, such as a first liner 10 and a second liner 20, may be removably received within the food receiving cavity 52 and then a food item may be deposited into the food receiving cavity 52 and therefore into the liner cavities 12, 22, of the liners 10, 20.

In some embodiments, the food container 50 may comprise a container wall 51 having a slightly tapering conical shape so that the container top end 53 may be generally larger than the container bottom end 54. In alternative embodiments, a the food container 50 may comprise a comprise a container wall 51 having a cylindrical shape so that the container top end 53 may be approximately the same size as the container bottom end 54.

The container wall 51 may comprise a second container interior surface 55 which may form and bound the food receiving cavity 52. All or portions of the container interior surface 55 may contact food items placed in the food receiving cavity 52 of the food container 50. In preferred embodiments, the container interior surface 55 and/or the container wall 51 may be made from or comprise a food-grade material such as nylon, polyurethane, vinyl, High-density polyethylene (HDPE), other types of polyethylene, polyvinyl chloride, rubber, silicone, or other similar food-grade material.

The container wall 51 may comprise a container exterior surface 56 which may form the exterior portions of the food container 50. In some embodiments, the food container 50 may comprise a container lip 59 which may extend around the container top end 53 and which may be configured to engage with lids commonly used to cover food item containers. In preferred embodiments, the container lip 59 may be raised or extended above the container exterior surface 56 so that the second container lip 59 will contact and seal to a lid commonly used to cover food item containers. In some embodiments, a container lip 59 may be raised or extended above the container exterior surface 56 by approximately 0.05 to 0.50 inches and more preferably 0.110 to 0.140 inches.

In some embodiments, the food container 50 may comprise one or more container supports 58 which may be positioned or disposed anywhere on the container exterior surface 56. In preferred embodiments, one or more container supports 58 may be positioned proximate to the container top end 53. In further embodiments, one or more container supports 58 may be coupled to the container lip 59. A container support 58 may be raised or extended above the container exterior surface 56 and may provide structural support and rigidity to the container wall 51. In some embodiments, a container support 58 may be raised or extended above the container exterior surface 56 by approximately 0.01 to 0.50 inches and more preferably 0.03 to 0.140 inches. In the examples of FIGS. 1, 4, and 5, the ribs 31 may comprise a generally linear shape. In alternative embodiments, a rib 31 may be configured in any shape and size.

FIGS. 5 and 6 illustrate an example of a food containing system 100 comprising a first liner 10, a second liner 20, and a food container 50 which may be nested together according to various embodiments described herein. One or more food container liners may be inserted into the food receiving cavity 52 of a food container 50 and one or more of the food container liners may rest against portions of the container interior surface 55 to prevent a food item deposited within the food receiving cavity 52 from contacting portions of the container interior surface 55. Additionally, one or more food container liners may be inserted into the liner cavity of another food container liner and one or more of the food container liners may rest against portions of the interior surface of the food container liner to prevent a food item deposited within the liner cavity from contacting portions of the interior surface of the food container liner. For example, a first liner 10 may prevent the deposited food item from contacting a portion of the container interior surface 55 of the food container 50 and a second liner 20 may prevent the deposited food item from contacting a portion of the first interior surface 15 of the first liner 10.

It should be understood that a food containing system 100 may comprise at least one food container liner 10, 20, and that in further embodiments, a food containing system 100 may comprise two or more food container liners 10, 20, and/or a food container 50. In still further embodiments, a food containing system 100 may comprise two or more food container liners 10, 20, and a food container 50 in which a first food container liner 10 is capable of being removable from the food receiving cavity 52 of the food container 50 and in which a second food container liner 20 is capable of being removable from the first liner cavity 12 of a first food container liner 10.

In some embodiments, a first food container liner 10 may be capable of being removable from a food container 50 by being nested within the food container 50. Preferably the container wall 51 may be conical in shape so that the container top end 53 is larger than the container bottom end 54 and the first side wall 11 may also be conical in shape so that the first top end 13 is larger than the first bottom end 14. Once a first liner 10 is inserted into the food receiving cavity 52 of the food container 50, the first lower lip 17 and/or the first upper lip 19 may contact and seal against the container interior surface 55 to limit the position of the first liner 10 within the food container 50 and to prevent a food item inserted into the food receiving cavity 52 from contacting those portions of the container interior surface 55 bounded by the first lower lip 17 and/or the first upper lip 19. Additionally, the one or more ribs 31 of the first liner 10 may create one or more air pockets between the first exterior surface 16 and the container interior surface 55 to facilitate the removal of the first liner 10 from the food container 50. In preferred embodiments, the first top end 13 may be positioned in contact with or proximate to the container top end 53 when the first liner 10 is inserted into the food receiving cavity 52 of the food container 50.

The container wall 51 may comprise a container wall height (H3), which may describe the distance between the container top end 53 and the container bottom end 54, and the first side wall 11 may comprise a first side wall height (H1), which may describe the distance between the first top end 13 and the first bottom end 14. In some embodiments, H1 may be less than or equal to H3. In further embodiments, H1 of the first liner 10 may be between 25% to 75% of H3 of the food container 50 so that the first side wall 11 of the first liner 10 may be between 25% to 75% of the height of the container wall 51 of the food container 50. In preferred embodiments, H1 of the first liner 10 may be between 61% to 71% of H3 of the food container 50 so that the first side wall 11 of the first liner 10 may be between 61% to 71% of the height, or approximately two-thirds the height, of the container wall 51 of the food container 50.

In some embodiments, a second food container liner 20 may be capable of being removable from a first liner 10 by being nested within the first liner 10. Preferably the second side wall 21 may be conical in shape so that the second top end 23 is larger than the second bottom end 24 and the first side wall 11 may also be conical in shape so that the first top end 13 is larger than the first bottom end 14. Once a second liner 20 is inserted into the first liner cavity 12 of the first liner 10, the second lower lip 27 and/or the second upper lip 29 may contact and seal against the first interior surface 15 to limit the position of the second liner 20 within the first liner 10 and to prevent a food item inserted into the first liner cavity 12 from contacting those portions of the first interior surface 15 bounded by the second lower lip 27 and/or the second upper lip 29. Additionally, the one or more ribs 31 of the second liner 20 may create one or more air pockets between the second exterior surface 26 and the first interior surface 15 to facilitate the removal of the second liner 20 from the first liner 10. In preferred embodiments, the second top end 24 may be positioned in contact with or proximate to the first top end 13 when the second liner 20 is inserted into the first liner cavity 12 of the first liner 10.

Similar to the H1 of the first liner 10, the second side wall 21 may comprise a second side wall height (H2), which may describe the distance between the second top end 23 and the second bottom end 24. In some embodiments, H2 may be less than or equal to H1. In further embodiments, H2 of the second liner 20 may be between 25% to 75% of H1 of the first liner 10 so that the second side wall 21 of the second liner 20 may be between 25% to 75% of the height of the first side wall 11 of the first liner 10. In preferred embodiments, H2 of the second liner 20 may be between 45% to 55% of H1 of the first liner 10 so that the second side wall 21 of the second liner 20 may be between 45% to 55% of the height, or approximately one-half the height, of the first side wall 11 of the first liner 10 and therefore between 28% to 38% of the height, or approximately one-third the height, of the container wall 51 of the food container 50.

While some materials have been provided, in other embodiments, the elements that comprise the system 100 such as one or more food container liners 10, 20, an optional food container, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the system 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the system 100 may be coupled by being one of connected to and integrally formed with another element of the system 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A food containing system for food containers capable of holding ice cream, the system comprising:

a. a first food container liner capable of being removable from a food container, the first food container liner having:

i. a first liner cavity;

ii. a first side wall bounding the first liner cavity, the first side wall having a first open top end, a first open bottom end, a first interior surface, and a first exterior surface; and iii. a first lip extending around the first bottom end, the first lip configured to contact the food container;

b. a second food container liner capable of being removable from the first liner cavity of the first food container liner, the second food container liner having:
   i. a second liner cavity;
   ii. a second side wall bounding the second liner cavity, the second side wall having a second open top end, a second open bottom end, a second interior surface, a second exterior surface; and
   iii. a second lip extending around the second bottom end, the second lip configured to contact the first interior surface of the first food container liner; and
   wherein the first top end and second top end are positioned proximate to each other when the second food container liner is positioned in the first liner cavity of the first food container liner.

2. The system of claim 1, further comprising a rib disposed on the first exterior surface of the first side wall.

3. The system of claim 2, wherein the rib is positioned proximate to the first top end.

4. The system of claim 1, further comprising a rib disposed on the second exterior surface of the second side wall.

5. The system of claim 4, wherein the rib is positioned proximate to the second top end.

6. The system of claim 1, wherein the second side wall of the second food container liner is between 25% to 75% of a height of the first side wall of the first food container liner.

7. A food containing system capable of holding ice cream, the system comprising:

a. a food container capable of holding ice cream, the food container comprising:
   i. a food receiving cavity;
   ii. a container wall bounding the food receiving cavity, the container wall having an open container top end, a container bottom end; a container interior surface; and a container exterior surface; and
   iii. a base coupled to the container bottom end;

b. a first food container liner capable of being removable from the food receiving cavity of the food container, the first food container liner comprising:
   i. a first liner cavity;
   ii. a first side wall bounding the first liner cavity, the first side wall having a first open top end, a first open bottom end, a first interior surface, and a first exterior surface; and
   iii. a first lip extending around the first bottom end, the first lip configured to contact the container interior surface of the food container;

c. a second food container liner capable of being removable from the first liner cavity of the first food container liner, the second food container liner having:
   i. a second liner cavity;
   ii. a second side wall bounding the second liner cavity, the second side wall having a second open top end, a second open bottom end, a second interior surface, a second exterior surface; and
   iii. a second lip extending around the second bottom end, the second lip configured to contact the first interior surface of the first food container liner; and wherein the second side wall of the second food container liner is between 25% to 75% of a height of the first side wall of the first food container liner.

8. The system of claim 7, further comprising a rib disposed on the first exterior surface of the first side wall.

9. The system of claim 8, wherein the rib is positioned proximate to the first top end.

10. The system of claim 7, further comprising a rib disposed on the second exterior surface of the second side wall.

11. The system of claim 7, wherein the first top end and second top end are positioned proximate to each other when the second food container liner is positioned in the first liner cavity of the first food container liner.

12. The system of claim 7, wherein the first side wall of the first food container liner is between 25% to 75% of a food container height of the container wall of the food container.

* * * * *